US011781380B1

(12) United States Patent
Victoriano

(10) Patent No.: US 11,781,380 B1
(45) Date of Patent: Oct. 10, 2023

(54) MULTI USE SUPPORT FIXTURE FOR USE WITH LADDERS

(71) Applicant: Jose Antonio Victoriano, Anchorage, AK (US)

(72) Inventor: Jose Antonio Victoriano, Anchorage, AK (US)

( * ) Notice: Subject to any disclaimer, the term of this patent is extended or adjusted under 35 U.S.C. 154(b) by 0 days.

(21) Appl. No.: 17/695,174

(22) Filed: Mar. 15, 2022

(51) Int. Cl.
*E06C 7/14* (2006.01)

(52) U.S. Cl.
CPC ..... *E06C 7/14* (2013.01)

(58) Field of Classification Search
None
See application file for complete search history.

(56) References Cited

U.S. PATENT DOCUMENTS

| | | | | | |
|---|---|---|---|---|---|
| 1,221,658 | A | | 4/1917 | Berry | |
| 1,455,221 | A | * | 5/1923 | Myers | E06C 7/14 248/231.71 |
| 2,367,256 | A | * | 1/1945 | Atkins | E06C 7/14 248/312.1 |
| 2,444,986 | A | | 7/1948 | Gebhardt | |
| 2,703,215 | A | * | 3/1955 | Weiss | E06C 7/14 248/210 |
| 3,353,778 | A | | 11/1967 | Sylvin et al. | |
| 3,986,694 | A | * | 10/1976 | Nowak | E06C 7/14 248/211 |
| 3,998,416 | A | | 12/1976 | Benolkin | |
| 4,025,016 | A | | 5/1977 | Brothers | |
| 4,139,173 | A | * | 2/1979 | Kahn | E06C 7/14 248/211 |
| 4,991,808 | A | | 2/1991 | LaChance | |
| 5,687,941 | A | * | 11/1997 | Quintile | E06C 7/14 248/210 |
| 5,855,346 | A | | 1/1999 | Hall | |
| 6,322,028 | B1 | | 11/2001 | Fleckstein | |
| D846,154 | S | | 4/2019 | Coe | |
| 2007/0163837 | A1 | * | 7/2007 | Dyer | E06C 7/14 182/129 |
| 2007/0193829 | A1 | * | 8/2007 | Astor | E06C 1/18 182/129 |
| 2012/0187266 | A1 | * | 7/2012 | Schirmacher | E06C 7/14 248/238 |

FOREIGN PATENT DOCUMENTS

| | | | | |
|---|---|---|---|---|
| GB | 2094874 A | * | 9/1982 | E06C 7/14 |
| GB | 2 197 377 A | | 5/1988 | |

* cited by examiner

*Primary Examiner* — Steven M Marsh
(74) *Attorney, Agent, or Firm* — Michael J. Tavella

(57) ABSTRACT

A fixture that fits over the rail of a ladder and is secured by setscrews. The fixture has a clamp portion and a flange that extends perpendicularly to the clamp portion. The flange can have a hole to place a hook to hang objects. A pair of fixtures can be used to support flat sheet materials ranging from a canvas board to a sheet of drywall or a wood panel. Supported by the flanges, the device lets a user measure and cut the drywall or paneling either horizontally or vertically. Moreover, with the fixtures positioned high on the ladder, it allows a user to climb the ladder and then place the drywall on a wall or ceiling. The fixtures can also hold a tool bucket so that the user can have, for example, a drill at hand to drive screws needed to hang the drywall or paneling.

9 Claims, 10 Drawing Sheets

MULTI USE SUPPORT FIXTURE FOR USE WITH LADDERS

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to support fixtures for ladders and particularly to multi-use support fixtures for use with ladders.

2. Description of the Prior Art

Ladders have been in use since the beginning of civilization. Today's ladders are used in all types of jobs—from construction to homeowners do it yourself projects. Most work ladders come in two types. The step ladder, which is hinged at the top and opens to stand freely, and the extension ladder, this can be extended to different heights and is usually supported by a building or other structure. Step ladders typically have a platform that pivots so that paint cans or other items can be held on it. This platform is typically found near the top of the ladder. In addition, some step ladders have a top that has a number of holes and a recessed portion to hold hand tools and small items such as screws.

Despite this functionality, all ladders lack a means for holding items such as drywall, prior to hanging. Also, although the platform at the top is useful, there are times when hanging a paint can from the ladder at a lower height might be best. The platform at the top, although useful, can be a problem. For example, a can of paint can fall off the platform quite easily. A means for carrying tools in a bucket, for example, is another feature that is desired but as yet, unavailable for use with step ladders.

To this end, several items have been developed for use with ladders. These are found in the following U.S. Pat. No. 1,221,658 to Berry, teaches a bracket that attaches to one of the rails of a ladder. The bracket is locked in position. A support for a bucket or other item is attached to the ladder bracket. The support is pivotably attached to the bracket and can be adjusted so that it remains level regardless of the angle of the ladder. U.S. Pat. No. 2,444,986 to Gebhardt teaches a bracket that hangs from a ladder rung. The bracket has a support attached that can hold a can. It also has a tool holder for holding a scraper or other hand tool. U.S. Pat. No. 3,353,778 to Sylvain et al. teaches a bracket that attaches to a ladder rail. This bracket has a screw attached that holds an arm that extends perpendicularly from the bracket. This arm has hooks that can be used to hang paint cans or other items. U.S. Pat. No. 3,998,416 to Benolkin teaches a tool holder and paint can support that is a platform that is attached to the rail of a ladder. An angular piece extends down from the platform to provide support for the platform. This angular piece contacts the ladder rail. U.S. Pat. No. 4,025,016 to Brothers, teaches a clamp that fits on a ladder rail. On one embodiment, the clamp has a bolt extension with a hook to hang paint cans. In another embodiment four clamps can be reconfigured to hold a bracket so that a canvas can be held, turning the ladder into an easel. U.S. Pat. No. 4,386,753 to Smith, teaches a bracket that fits over a rail and rung of a ladder. It has a holder that can pivot to remain level regardless of the ladder angle. U.S. Pat. No. 4,991,808 to LaChance teaches a long bracket that fits over a side rail of a ladder. Brackets on the inside of the long bracket fit over two rungs to provide support for the device. A support for items is pivotably attached to hold paint cans, roller trays and other items level. U.S. Pat. No. 5,855,346 to Hall teaches a clamp that attaches to a rail of a ladder such that the weight of the device holds the clamp tighter. A tray is attached to the side of the clamp to support paint cans, etc. U.S. Pat. No. 6,322,028 to Fleckenstein teaches an L shaped bracket that has a first arm that attaches to a ladder rail and a second arm that clamps to a paint can or other item. Patent No. D846,154 to Coe teaches a design for a universal clamp for a ladder.

In addition, a United Kingdom Patent GB 2 197 377 A, to Rayner, teaches an attachment that has a hook part that fits over a ladder rung. Attached to the hook part is a bracket that has a support attached to it.

All of these devices tend to be large, and complicated. Some have large trays that fold up and have braces to support items. While the flat platform is handy, it is also problematic because it is easy to upset items on these platforms. Others are designed for a very narrow purpose and are thus limited in their use.

BRIEF DESCRIPTION OF THE INVENTION

The instant invention overcomes the difficulties described above.

It is a fixture that fits over the rail of a ladder. Setscrews secure the fixture to the ladder rail. The fixture has a flange that extends perpendicularly outward and forward of the fixture. The flange can have a hole to place a hook to hang objects such as a tool bucket or a can of paint. Because the flange also extends forward of the ladder rail, a pair of fixtures, one on each rail (a left and right model) can be used to support flat sheet materials ranging from a canvas board to a sheet of drywall or a wood panel. Supported by the flanges, the device lets a user measure and cut the drywall or paneling either horizontally or vertically. Moreover, with the fixtures positioned high on the ladder, it allows a user to climb the ladder and then place the drywall on a wall or ceiling. Additionally, because the fixtures can hold a tool bucket, the user can have a drill at hand to drive screws needed to hang the drywall or paneling.

DETAILED DESCRIPTION OF THE INVENTION

Figure 1:
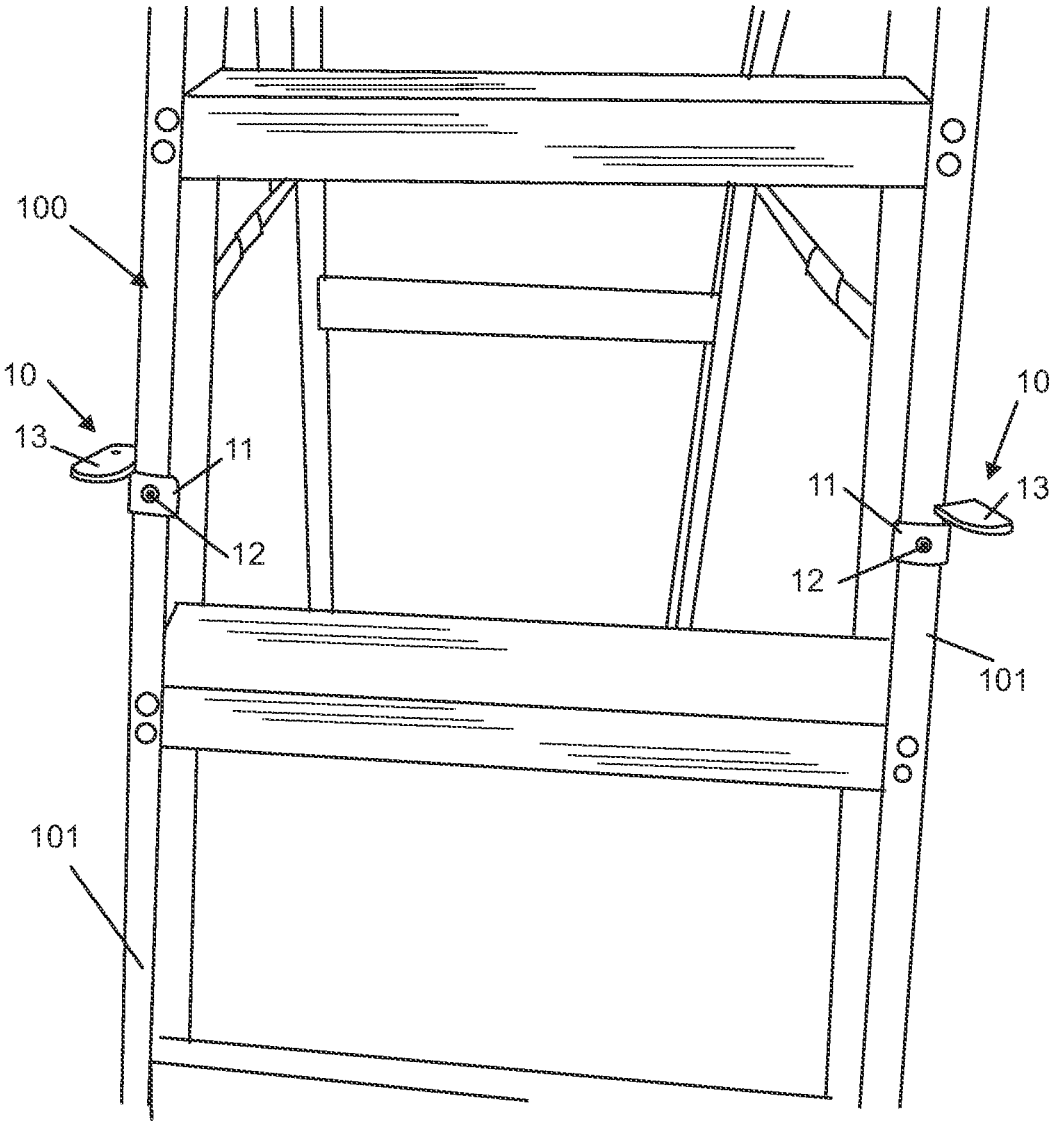
FIG. 1 is a front view of a ladder showing two fixtures in position.

Referring now to the drawings and especially FIGS. 1-5, the invention is a fixture 10. FIG. 1 is a front view of a ladder showing two fixtures 10 in position on the ladder 100. Note that the fixture 10 has a right-hand and left-hand version. FIG. 1 shows the two fixtures 10 are in position on the rails 101. Each of the fixtures 10 has a clamp portion 11 that is secured to the rail 101 using a set screw 12. As discussed below, each of the fixtures 10 have horizontal flange portions 13 that extend outward and forward from the rails 101.

Figure 2:
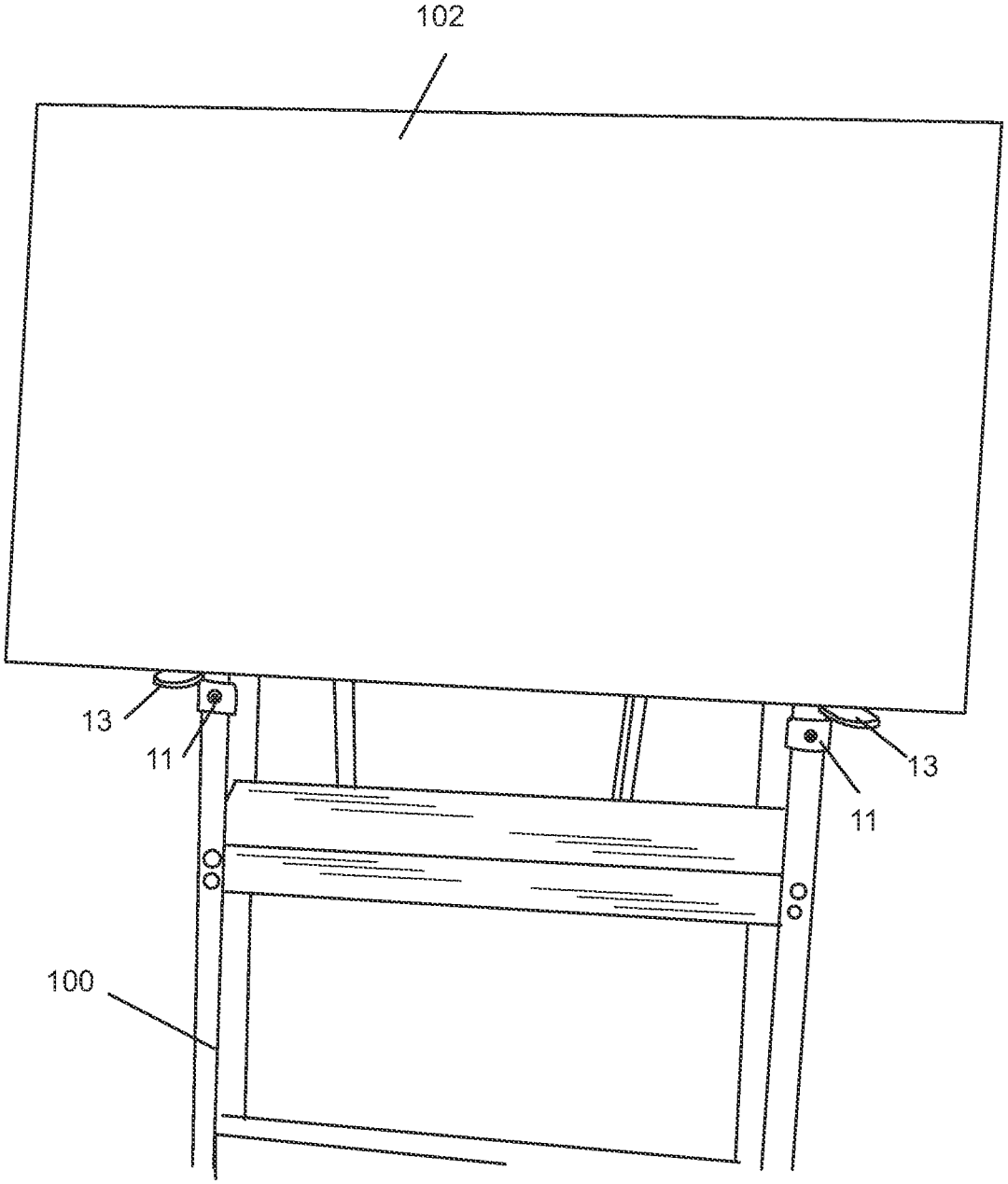
FIG. 2 is a front view of a ladder showing two fixtures in position supporting a sheet of flat material.

FIG. 2 is a front view of a ladder showing two fixtures in position supporting a sheet of flat material. Here the fixtures 10 are shown supporting a flat piece of sheet material 102. This material can be anything from a sheet of drywall or a piece of wood paneling to an artist's canvas. Placement of the sheet 102 on the flanges 13 of the fixtures 10 allows a worker to cut the sheet either vertically or horizontally. It also allows a worker to climb the ladder and place the sheet 102 on a wall or ceiling (not shown) for mounting. As discussed below, with a fixture having a hole and a hook (see, e.g., FIG. 10), the worker can have a tool bucket hanging from a fixture 10 so that when the sheet 102 is placed, the worker can easily access a drill to secure it to a wall, for example.

Figure 3:
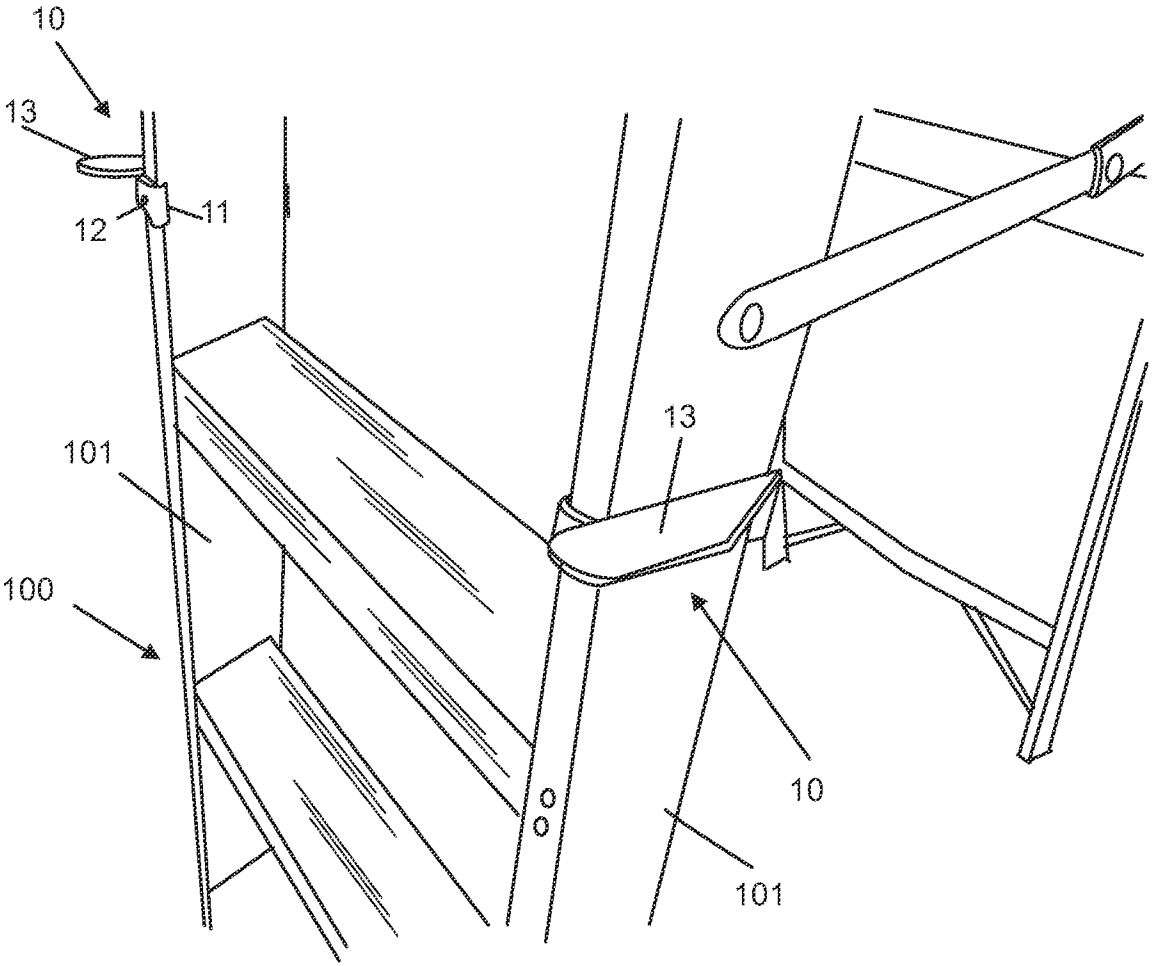
FIG. 3 is a perspective detail view of a ladder showing a pair of fixtures installed with the right-hand fixture shown with no hole.

FIG. 3 is a perspective detail view of a ladder 100 showing a pair of fixtures 10 installed with the right-hand fixture shown having no hole in the flange 13. This view also shows the clamp portion 11 fitted to the rail 101.

Figure 4:
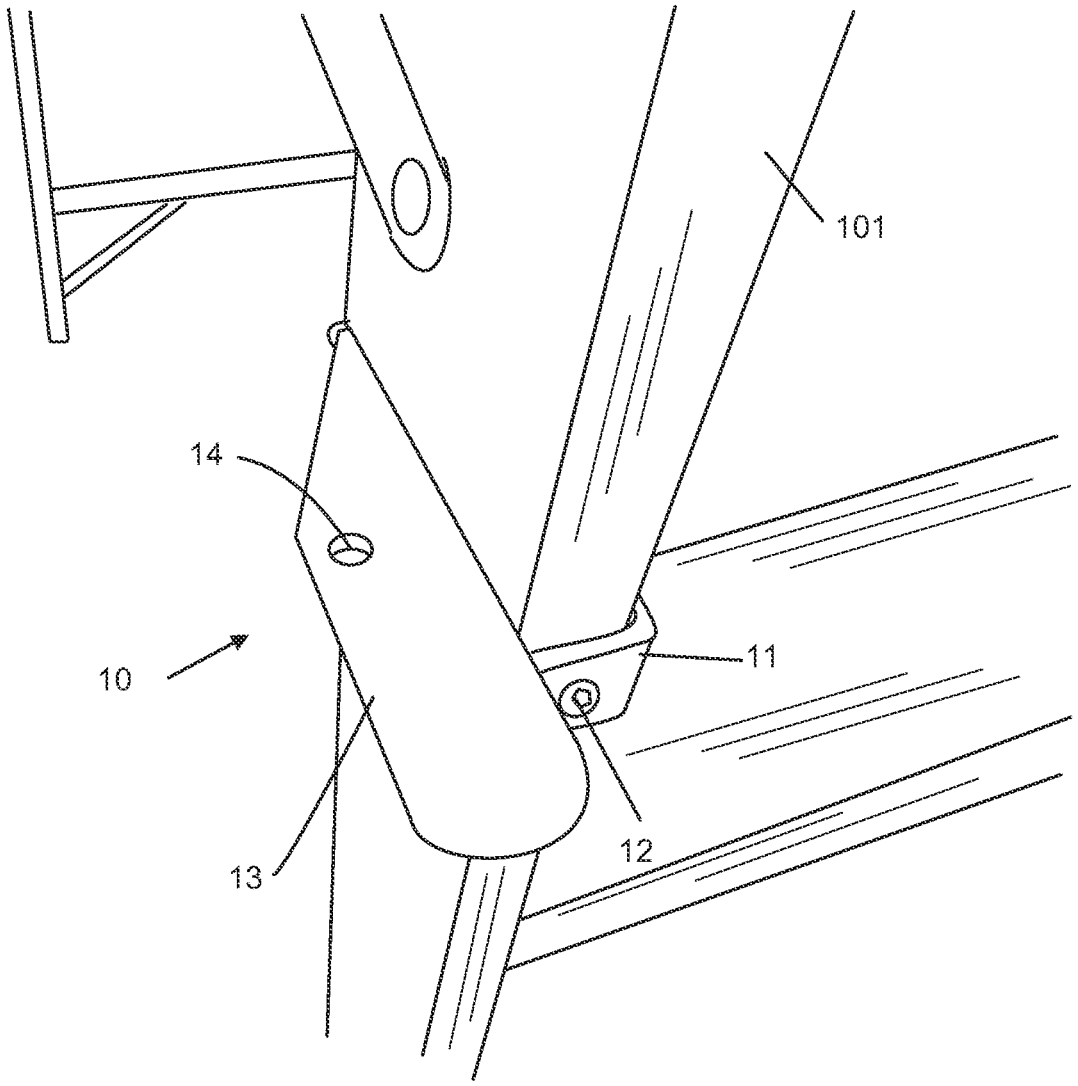
FIG. 4 is a top perspective view of a left-hand fixture showing the flange with a hole.

FIG. 4 is a top perspective view of a left-hand fixture, attached to a ladder 100 rail 101 showing the flange 13 with a hole 14. Note that this view also shows the clamp portion 11 and the setscrew 12, which is considered to be a means for securing the clamp to a ladder rail, attached to the rail 101.

Figure 5:
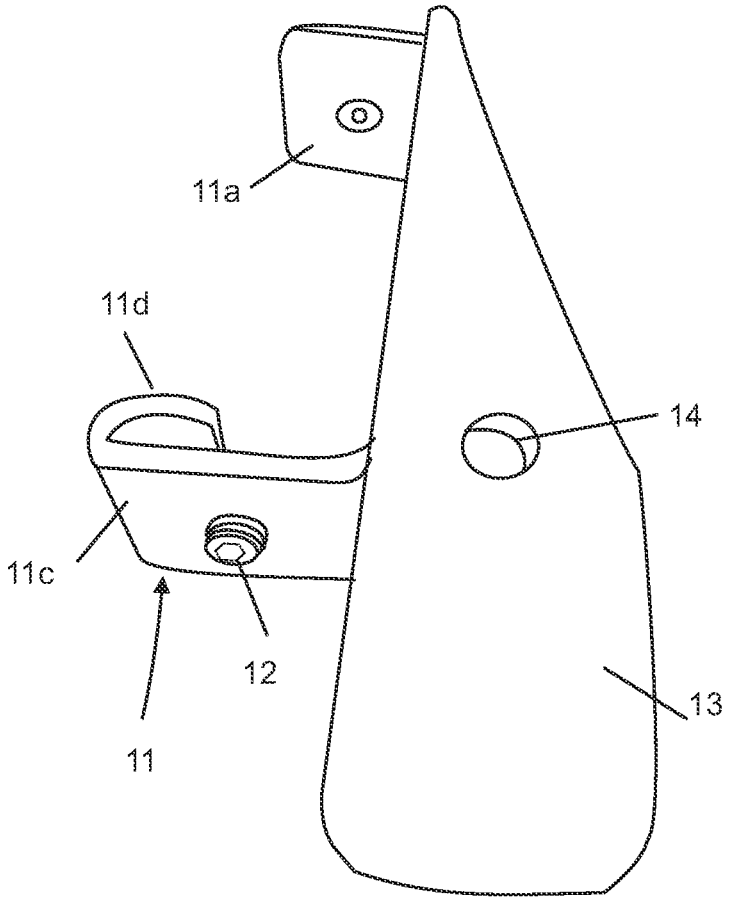
FIG. 5 is a top perspective view of a right-hand fixture showing a hole formed therein.

FIG. 5 is a top perspective view of a right-hand fixture 10 showing a hole 14 formed in the flange 13. This view also shows part of the clamp 11, which is a fixture that has a rear portion 11*a*, and a front portion 11*c* as shown. Note that the front portion 11*c* has a curved edge 11*d* that fits tightly on the rim of a ladder (see, e.g., FIG. 1). Note the setscrew 12 as well.

Figure 6:
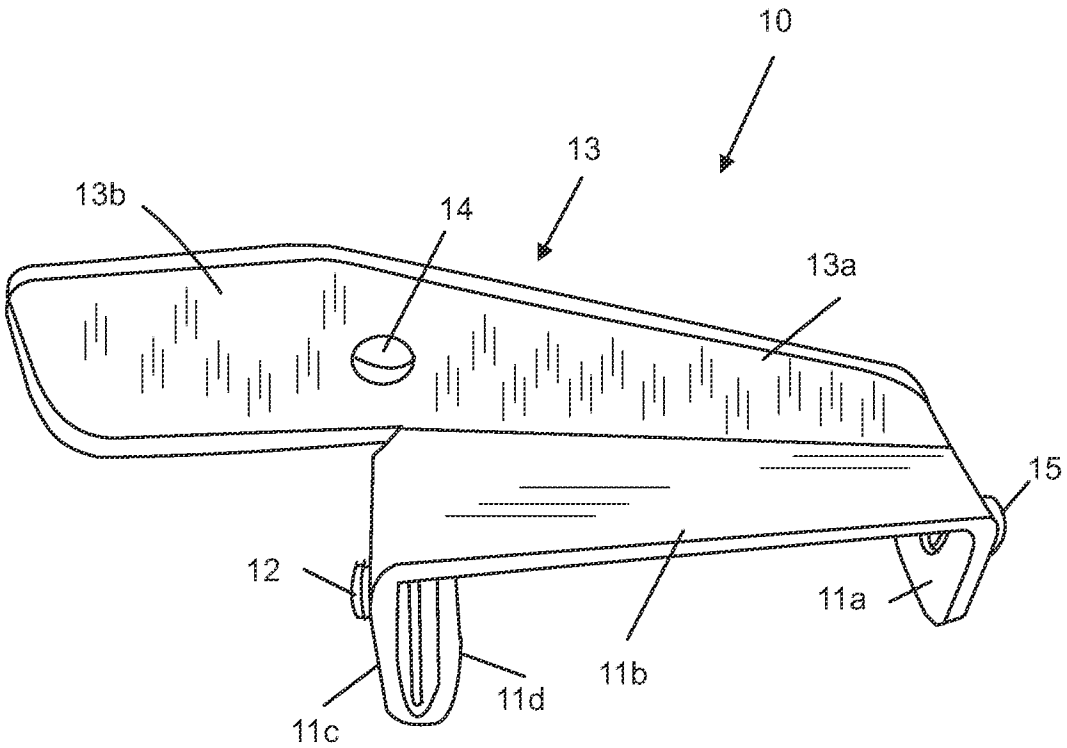
FIG. 6 is a bottom perspective view of a right-hand fixture showing a hole formed therein.

FIG. 6 is a bottom perspective view of a right-hand fixture 10 showing a hole 14 formed in the flange 13. In this view, the entirety of the clamp portion 11 is shown. Note that the clamp 11 has a rear portion 11*a*, which also has a setscrew 15 in it. The center portion 11*b*, the front portion 11*c* and the curved edge 11*d* are shown. Note too, the setscrew 12. Note that the flange 13 is not rectangular. It has a triangular rear portion 13*a* and a front portion 13*b*. Note the hole 14 is positioned in a central location. In the preferred embodiment, the hole is positioned as shown. If the hole is too far forward, it limits the use of the hole to hold items and still have the fixture be used to hold sheet material. If the hole is too far back, it limits the weight if can hold.

Figure 7:
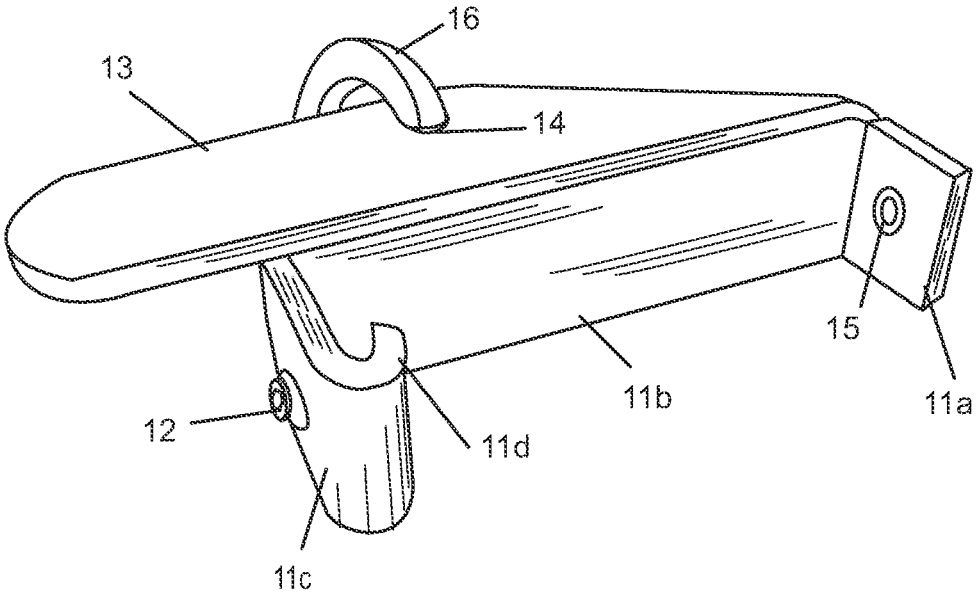
FIG. 7 is a side perspective view of the inside of a left-hand fixture showing a hook in the hole in the flange.

FIG. 7 is a side perspective view of the inside of a left-hand fixture clamp 11 showing a hook 16 in the hole in the flange 13. Here again, the full clamp portion 11 is shown. Note the rear portion of the clamp 11*a*, which also has a setscrew 15 in it. The center portion 11*b*, the front portion 11*c* and the curved edge 11*d* as shown. Note too, the setscrew 12. The flange 13 also has a curved front edge 13*c*. The device has curved edges, which remove sharp corners from the flange 13, which can cause injury if struck. It also prevents damage to sheet materials as well. Note the hook 16, which fits into the hole 14. In the preferred embodiment, the hook 16 is an "5" shaped hook. The hook is used to support items, as discussed below.

Figure 8:
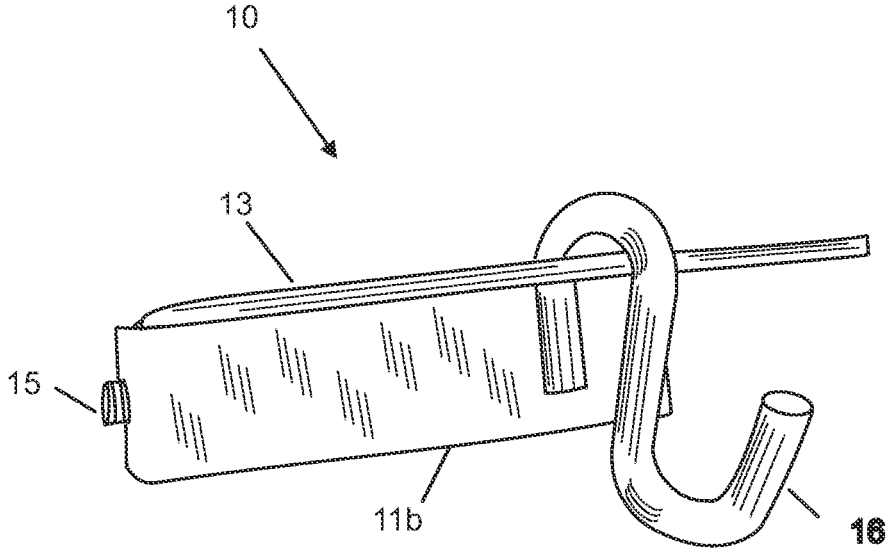
FIG. 8 is a side perspective view of a left-hand fixture showing a hook in the hole in the flange.

FIG. 8 is a side perspective view of a left-hand fixture 10 showing a hook 16 in the flange 13. Here the clamp portion 11 is shown. Note the rear setscrew 15. The "5" shaped hook 16 is shown in place in the flange 13.

Figure 9:
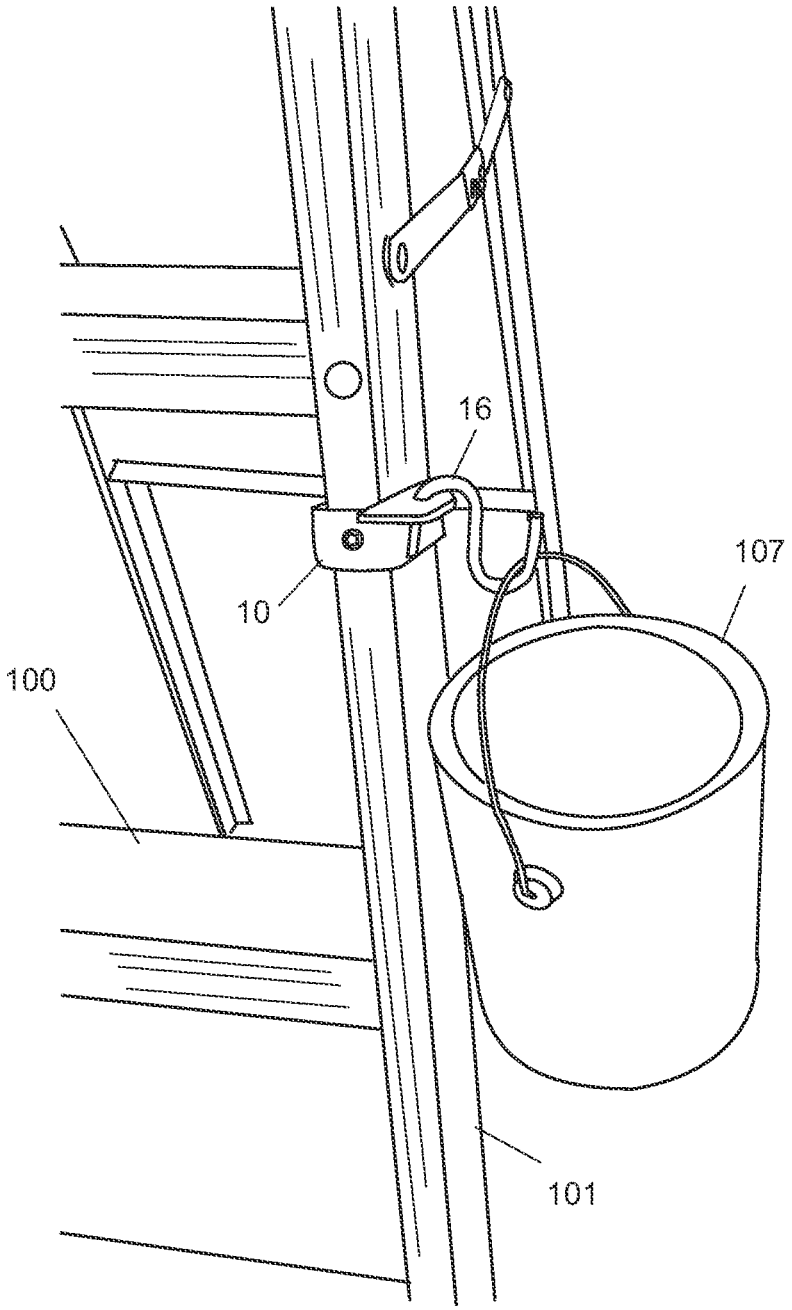
FIG. 9 is a detail view of a ladder showing a fixture with a paint can suspended from the hook in the flange.

FIG. 9 is a detail view of a ladder 100 showing a fixture 10 with a paint can 104 suspended from the hook 16 in the flange 13. Note, that the paint can 104 is positioned behind and below the front portion 13*b* of the flange 13. In this way, the flange 13 can still be used to hold sheet materials, if desired.

Figure 10:
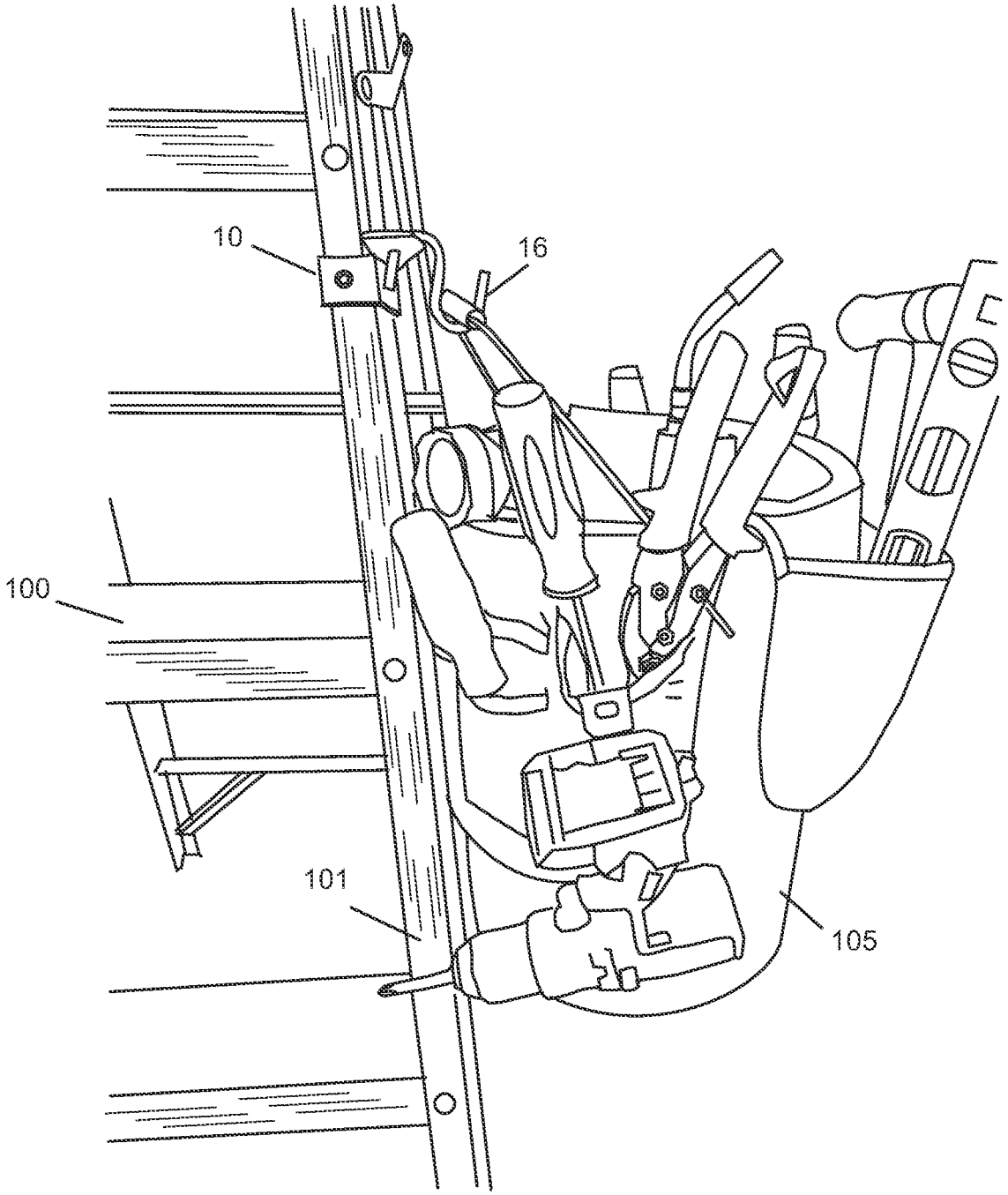
FIG. 10 is a detail view of a ladder showing a fixture with a tool bucket suspended from the hook in the flange.

FIG. 10 is a detail view of a ladder 100 showing a fixture 10 with a tool bucket 105 suspended from the hook 16 in the flange 13. Note that the fixture is capable of supporting a considerable load, as shown in the figure. The tool bucket with a load of tools is substantial.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A multi-use support fixture for use with ladders having a right rail and a left rail comprising:

a) a clamp portion having a front, a back, and a center having a top;

b) a means for securing said clamp portion to one of said ladder rails; and c) a flange portion, lying in a horizontal plane, attached to the top of said center of said clamp portion, and extending outwardly from said clamp portion said flange portion also having a generally rectangular front portion, extending, also in a horizontal plane, forward of said clamp and said rail of said ladder.

2. The multi-use support fixture of claim 1 wherein said flange portion is a solid member.

3. The multi-use support fixture of claim 2 wherein said flange portion has a hole formed therein.

4. The multi-use support fixture of claim 3 wherein a hook is installed in said hole on said flange.

5. The multi-use support fixture of claim 4 wherein the hook has an "S" shape.

6. The multi-use support fixture of claim 1 wherein the means for securing the clamp to one of said ladder rails comprises a setscrew installed in said front of said clamp portion.

7. The multi-use support fixture of claim 1 wherein the means for securing the clamp to one of said ladder rails comprises a setscrew installed in said front of said clamp portion, and a setscrew installed in said back of said clamp portion.

8. The multi-use support fixture of claim 1 wherein the front and back of said clamp portion are curved to fit around the rail of said ladder.

9. The multi-use support fixture of claim 1 wherein the flange portion further includes a rear triangular portion.

* * * * *